US011266286B2

(12) United States Patent
Letsky

(10) Patent No.: US 11,266,286 B2
(45) Date of Patent: Mar. 8, 2022

(54) FLOOR CLEANING ROBOT AND DOCKING STATION THEREFORE

(71) Applicant: Michael Letsky, Boca Raton, FL (US)

(72) Inventor: Michael Letsky, Boca Raton, FL (US)

(73) Assignee: FutureGenTechnologies Inc., Boca Raton, FL (US)

( * ) Notice: Subject to any disclaimer, the term of this patent is extended or adjusted under 35 U.S.C. 154(b) by 399 days.

(21) Appl. No.: 16/600,132

(22) Filed: Oct. 11, 2019

(65) Prior Publication Data

US 2020/0121153 A1 Apr. 23, 2020

Related U.S. Application Data

(60) Provisional application No. 62/747,519, filed on Oct. 18, 2018.

(51) Int. Cl.

| | |
|---|---|
| ***A47L 11/40*** | (2006.01) |
| ***A47L 9/28*** | (2006.01) |
| ***A47L 11/282*** | (2006.01) |

(52) U.S. Cl.

CPC ..... *A47L 11/4025* (2013.01); *A47L 9/2873* (2013.01); *A47L 11/282* (2013.01); *A47L 11/4011* (2013.01); *A47L 11/4083* (2013.01); *A47L 2201/022* (2013.01); *A47L 2201/024* (2013.01); *A47L 2201/026* (2013.01)

(58) Field of Classification Search

CPC .. A47L 11/4025; A47L 9/2873; A47L 11/282; A47L 11/4011; A47L 11/4083; A47L 2201/022; A47L 2201/024; A47L 2201/026; A47L 11/4038; A47L 2201/028; A47L 7/0038; A47L 9/0063

See application file for complete search history.

(56) References Cited

U.S. PATENT DOCUMENTS

| | | | | |
|---|---|---|---|---|
| 2018/0368646 | A1* | 12/2018 | Buehler | A47L 11/4011 |
| 2020/0022553 | A1* | 1/2020 | Gill | A47L 9/2873 |
| 2021/0177228 | A1* | 6/2021 | Windmeisser | A47L 11/40 |

* cited by examiner

*Primary Examiner* — David Redding

(74) *Attorney, Agent, or Firm* — Lewis Brisbois Bisgaard & Smith LLP; Howard M. Gitten

(57) ABSTRACT

A system for autonomously cleaning a floor has a robot having a chassis. A clean water tank and a dirty water tank are disposed within the chassis. A valve in fluid communication with the dirty water tank receives dirty water from a cleaning surface during a cleaning operation. A docking station has a platform. A docking station drain communicates with the valve for receiving contents of the dirty water tank when the robot is in the docking station. A water source communicates with the clean water tank to fill the clean water tank when the robot is in the docking station. A charging structure charges the robot when the robot is in the docking station.

25 Claims, 3 Drawing Sheets

FLOOR CLEANING ROBOT AND DOCKING STATION THEREFORE

CROSS REFERENCE TO RELATED APPLICATION

This application claims priority to and benefit from U.S. Provisional Application No. 62/747,519 filed Oct. 18, 2018 and entitled "Floor Cleaning Robot And Docking Station Therefore," which application is hereby incorporated by reference in its entirety.

BACKGROUND OF THE INVENTION

The present invention relates to a floor cleaning robot, and more particularly to a robot and docking station for autonomously cleaning a floor using a liquid cleaning agent.

With the rise of high intensity workout training centers such as CrossFit, Orange Theory, and similar high intensity workout centers, there has been an increase in indoor spaces that become dirty and must be kept clean because people work out in those spaces on those floors. In the market today gym owners clean dirty gym floors using manual scrubbers such as the Bulldog 200. The average gym center floor ranges from 2,500 to over 4,000 square feet of dirty floor space.

Gym clean up requires the use of liquid cleaners to disinfect as well as clean the gym floor area. These prior art cleaning devices are large, taking up much needed space, particularly in urban environments. Most gym workout centers have limited floor space available for cleaning supplies and therefore cannot locally store the devices, making use on demand difficult.

Lastly, operation and maintenance of the manual floor cleaners is time intensive, limiting the hours and number of times such a cleaning operation can be done. No robot floor cleaner on the market today can clean such a large area.

Accordingly, there is a need for a robotic cleaning system which overcomes the shortcomings of the prior art.

SUMMARY OF THE INVENTION

A system for autonomously cleaning a floor includes a robot and a docking station. The robot has a chassis. A clean water tank is disposed within the chassis. A dirty water tank is disposed within the chassis. A two-way valve is in fluid communication with the dirty water tank for receiving dirty water from a cleaning surface during a cleaning operation for collection in the dirty water tank.

A docking station has a platform for supporting the robot when the robot is in a docked position. The docking station has a drain disposed in the platform communicating with the two-way port for receiving contents of the dirty water tank when the robot is in the docked position. A water source communicates with the clean water tank to fill the clean water tank when the robot is in the docked position. A charging structure on the docking station charges the robot when the robot is in the dock position.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE PREFERRED EMBODIMENTS

Figure 1:
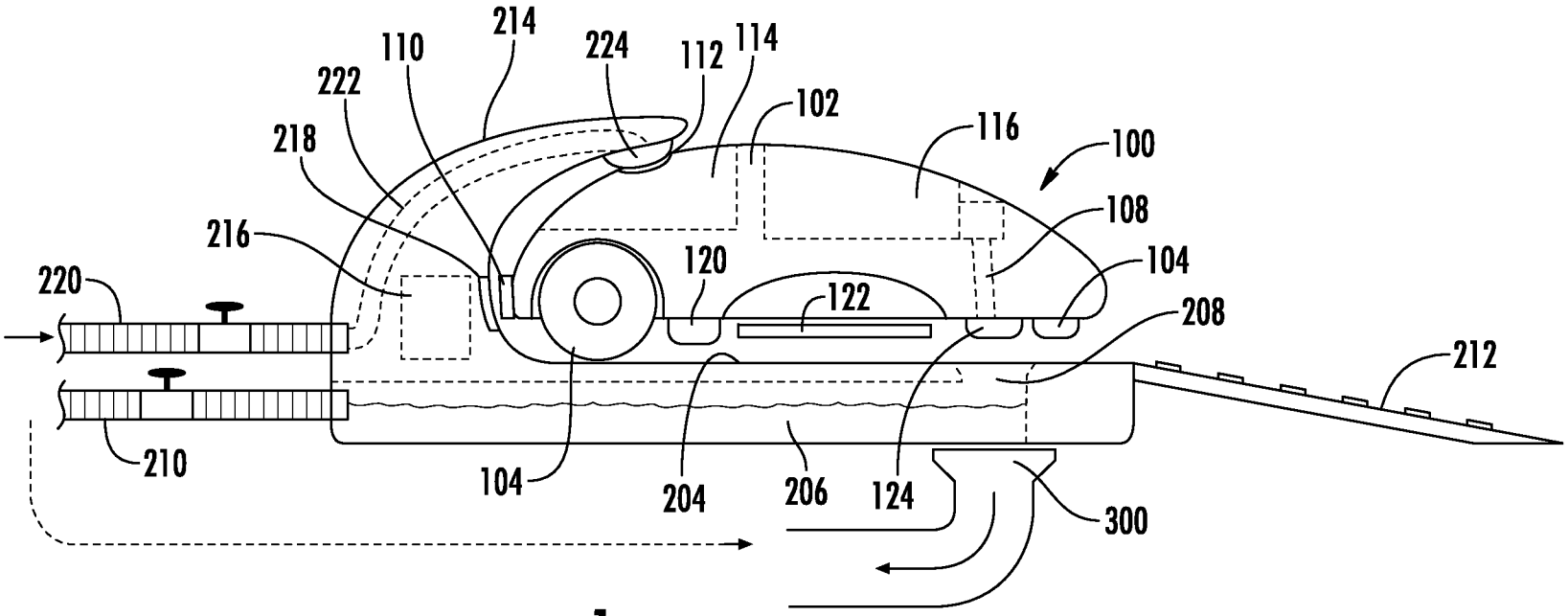
FIG. 1 is a schematic side elevational view of a floor cleaning robot and docking station constructed in accordance with the invention.
Figure 2:
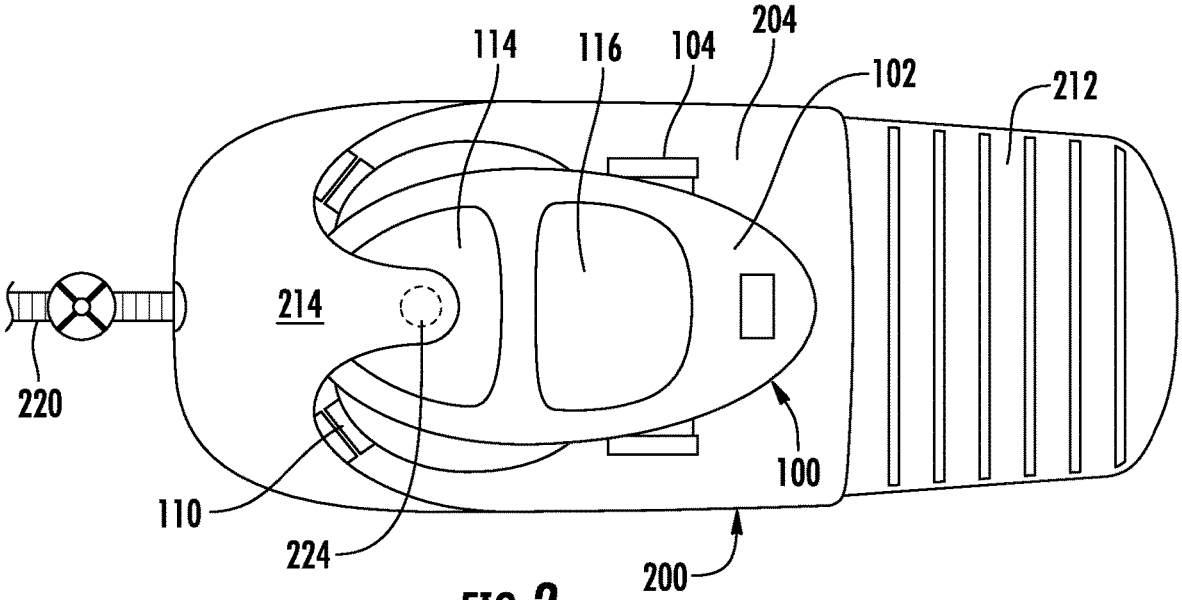
FIG. 2 is a top plan view of the floor cleaning robot and docking station constructed in accordance with the invention.

Reference is initially made to FIGS. 1 and 2 in which a robotic floor cleaning system generally indicated as 400, constructed in accordance with the invention is provided. Floor cleaning system 400 includes a floor cleaning robot 100 and docking station 200. Docking station 200 operates on robot 100 as more fully described below.

Cleaning robot 100 includes a chassis 102 and three or more wheels 104 affixed to chassis 102. An electric motor, not shown, but as known in the art, drives wheels 104 under computer control. A clean water tank 114 is disposed within chassis 102 for storing a supply of clean water for use by cleaning robot 100 as described below. A dirty water tank 116 is disposed within chassis 102 for storing dirty water during the cleaning operation of cleaning robot 100 as described below. Although not shown, in a preferred non-limiting embodiment, a cleaning fluid tank may also be disposed within chassis 102. As seen in FIG. 2 each of tanks 114 and 116 may be transparent forming windows in chassis 102 enabling a user to view the condition of the liquids within the respective tanks.

Cleaning robot 100 is powered by an onboard electric motor (not shown). Electrical current contacts 110 for charging an on board battery associated with the electric motor are provided on an exterior surface of chassis 110 at a position to engage charging contacts 218 of docking station 200.

A liquid dispenser 120 is disposed on a lower, floor facing, surface of chassis 100. Liquid dispenser 120 is in fluid communication with clean water tank 114 and/or the cleaning fluid tank. A scrubbing pad, preferably a rotating brush, 122 is disposed along the lower surface of chassis 100 adjacent dispenser 120, downstream of dispenser 120 in an operating direction of chassis 100, so as to clean the floors utilizing liquid dispensed from liquid dispenser 120. A two-way port 124 for intaking liquid on the floor during the cleaning operation and transmitting the dirty fluid to dirty water tank 116 is disposed on the lower surface of chassis 102; operationally downstream of dispenser 120 and cleaning rotating brush 122. Two-way port 124 is in liquid communication with dirty water tank 116 by a drain channel 108 and acts as a valve.

During a cleaning operation two-way port 124 is under negative pressure, such as a vacuum, to intake dirty water from a floor being clean. Two way port 124 is also, as will be discussed below, an outlet port for draining dirty water tank 116.

Docking station 200 includes a body 202 having a platform 204 for receiving cleaning robot 100. A drainage tank 206 is disposed in platform 204 and is in fluid communication with a station drainage tank 206. Drainage tank 206, to make use of gravity, is disposed below platform 204 giving platform 204 height. A ramp 212, extending from platform 204, is provided for cleaning robot 100 to provide access to platform 204.

Figure 3:
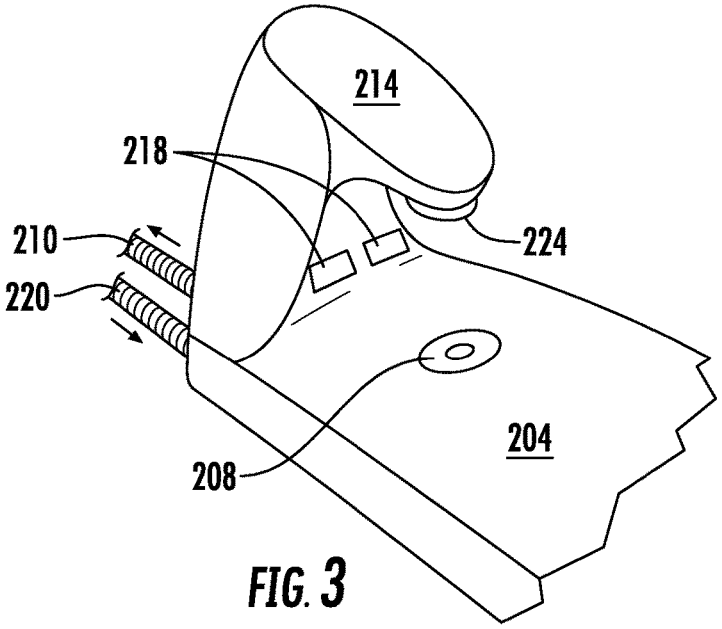
FIG. 3 is a partial perspective view of the docking station constructed in accordance with the invention.

A drain hole 208 is positioned to be in fluid communication with two-way dispensing port 124 when robot 100 is docked in docking station 200 and provides fluid communication between two way port 124 and platform drainage tank 206 for receiving dirty water from dirty water tank 116. As seen in FIG. 3 drain hole 208 is positioned a distance along platform 204 from contacts 218 corresponding to a distance from contacts 110 to two way port 124 of cleaning robot 100. Therefore, when cleaning robot 100 is in a docked position within docking station 200 two-way port 124, during dispensing, substantially overlies drain hole 208. In this way, alignment for draining is guaranteed.

However, in alternative embodiments, platform 200 may communicate directly with a gym drain 300, part of the plumbing of the facility, as known in the art; removing the need for dirty water tank 206. Alternatively in another alternative embodiment, dirty water tank 206 may be emptied manually by making the tank removable for dumping into a sink. Lastly tank 206 may be provided with a drainage conduit 210 as additional plumbing to convey dirty water from dirty water tank 206 to a remote dirty water removal plumbing.

A docking arm 214 extends from platform 204 to form a receiving area for receiving and positioning cleaning robot 100 within docking station 200. In a preferred nonlimiting embodiment, much of the operational structure of docking station 200 is provided within arm 214. The electronics 216 (shown in phantom) for operating docking station 200 are disposed within arm 214. Charging contacts 218 are connected to a power source (not shown) and disposed along docking arm 214 at a position to operatively engage, whether inductively, or with direct contact, contacts 110 of cleaning robot 100 when cleaning robot 100 is in the dock position disposed on platform 204.

Clean water tank 114 may be filled by manually. However, in the preferred nonlimiting embodiment, the structure for filling clean water tank 114 is provided in docking arm 214. A conduit 220 in fluid communication with a water supply such as a sink, dedicated water source or the like extends from outside of docking station 200 through arm 214, via hosing 222 (shown in phantom) to a filler port 224. Filler port 224 is disposed at a position to be in fluid communication with a fill port 112 disposed on clean water tank 114. In a preferred nonlimiting embodiment, filler port 224 is at a position relative to clean water tank 114 to rely on gravity to fill clean water tank 114.

In a further embodiment, a mixture of cleaners may be mixed in the water supply. The cleaners may be stored in a tank, not shown, within robot 100. In a further embodiment, docking station 200 has a third reservoir (not shown) for a cleaning solution. Yet another embodiment, the cleaning solution may be added by liquid or solid to the clean water supply through an in-line dispenser or cartridge.

To facilitate autonomous floor scrubbing, docking station 200 enables the cleaning robot 100 to discharge dirty water. In a preferred embodiment, the discharge structure at docking station 200 is a drain (208, 300) located under robot 100 when robot 100 drives onto platform 204. When robot 100 is docked within docking station 200, robot 100 on board electronics open two way port 124 to empty the dirty water from dirty water tank 116 through drain 208 either directly into drain 300, or into dirty water tank 206. In turn, dirty water tank drainage 206 is coupled through drainage conduit 210 to an exterior drain in the building, or existing plumbing. In yet another embodiment docking station 200 removes the dirty water from dirty water drainage tank 206. The docking station drain 208, in an alternative embodiment, may use suction to remove water from robot floor cleaner 100 and dirty water tank 116; although the configuration, also allows gravity to drain dirty water tank 116 into drainage tank 206.

In a preferred embodiment, docking station 200 has Wi-Fi and connects with the user's Wi-Fi router connection. The Wi-Fi connection allows the robot floor cleaner 100 schedule to be set or adjusted remotely by phone application, web portal, or third-party device such as a smart hub, Google home, Amazon Alexa, etc. In a preferred embodiment, docking station 200 tells robot floor cleaner 100 when to begin cleaning. In yet another embodiment, robot floor cleaner 100 has a touchscreen and corresponding electronics enabling a user to set and configure the Wi-Fi settings, floor cleaning schedule, desired water temperature, notification settings for the robot, or the like in accordance with the user preferences. In a preferred nonlimiting embodiment, docking station 200, instructs cleaning robot 100 when to begin cleaning.

During installation, a user installs docking station 200 in the same work area which needs to be cleaned. Docking station 200 is plumbed to a freshwater supply for clean water inlet as water supply 220. Docking station 200 is also connected to a drain 210, 300.

In the preferred embodiment, robot docking station 200 may contain a clean water reservoir capable of storing a number of gallons of clean water. In the preferred embodiment, docking station 200 has a clean water reservoir capable of holding 10 gallons of clean water or more. The amount of clean water required depends on the size of the work area. In the most preferred embodiment, to autonomously drain dirty water docking station 200 may be plumbed to a hose such as water outlet/drain 210, a flexible piping, to direct the wastewater to a designated discharge area.

In a preferred nonlimiting embodiment, docking station 100, as result of its compact size, may be located in a room connected to the main work area such as a storage closet with access to the work area.

During operation, the user unpacks robot floor cleaner 100 and places it in docking station 200. A user then turns on robot floor cleaner 100 for the first time. Robot floor cleaner 100 registers, via radio, with docking station 200. Radio communication may be by Bluetooth, Wi-Fi, ZigBee or any similar radio communication protocol. The user, preferably using Wi-Fi, then inputs settings for the floor robot cleaner 100 and docking station 200. The user communicates with docking station 200 or floor cleaner robot 102 inputs the setting such as the cleaning schedule.

Once the setting have been set, robot floor cleaner 100 waits for the battery onboard robot floor cleaner 100 to become fully charged. Once charged, robot 100 will wait for the first scheduled cleaning schedule to start the cleaning process.

During cleaning, robot floor cleaner 100 will undock from docking station 200. Robot floor cleaner 100 will autonomously find a wall and travel along the wall of the work area, recording a travel path, until the entire boundary of the work area has been defined. In another embodiment, the user may drive robot floor cleaner 100 around the outside perimeter of the work area. In yet another embodiment robot floor cleaner 100 performs mapping utilizing this simultaneous localization and mapping processing.

During cleaning mode, floor cleaning robot 100 will disperse liquid from the clean water tank 112 through dispenser 120. The liquid provides lubrication to the rotating cleaning brush 122 which makes contact with the cleaning surface. Then the liquid is removed through two-way portal 124 through suction to dry the cleaning surface as floor cleaning robot 100 moves.

The dirty water is stored in the robot dirty water tank 116. When dirty water tank 116 is full, or clean, water reservoir 114 is at a low level, as indicated by an onboard tank level sensor, cleaning floor robot 100 returns to docking station 200 to perform one or more operations. These operations may include at least one of emptying dirty water tank 116 into docking station dirty water tank 206 or drain 300; fill clean water tank 114, and/or charge a battery of robot floor cleaner 100.

If the above operations happen prior to completion of the cleaning of the entire floor surface, robot floor cleaner 100 will store its last known position in a robot floor cleaner map before returning to docking station 200. Robot floor cleaner 100 will return after the above docking station operations have been completed to restart the cleaning operation at the last known position.

In one embodiment robot floor cleaner 100 determines its current position utilizing wheel encoders. A coordinate system begins at docking station 0, 0. Robot floor cleaner 100 provides correction to the measurements from the wheel encoders by using infrared/sonar range measurements when close to work area boundaries and obstacles. In yet another embodiment, the position of robot floor cleaner 100 may be determined by positioning system such as GPS for outdoor locations, or indoor positioning measurement techniques as known in the art.

If robot floor cleaner 100 detects that wheel slip has occurred resulting in measurement error, robot floor cleaner 100 will return to the docking station 200 by following a path determined by the robot's path planning algorithm to be the shortest navigable path to the initial point 0, 0. Robot floor cleaner 100 will then work in parts of the work area that have not yet been visited by floor cleaner robot 100. In a preferred nonlimiting embodiment, robot floor cleaner information may be transmitted to docking station 200 in real-time or near real time for display to an end-user. The display may be by smart phone, tablet, computer or similar device.

For maintenance, the rotating pad 122 of robot floor cleaner 100 may be removed, washed and/or replaced when needed by the end-user. As is understood, the clean and dirty tanks 114, 116 may be removed by an end-user for maintenance. The onboard battery may be replaced when needed and robot floor cleaner 100 docking station 200 may receive firmware updates over the air as needed.

The floor cleaner robot as described above is compact to be stored on the gym floor in a convenient spot. In one embodiment, floor cleaner robot 100 may contain a water heating system to generate steam.

Figure 4:
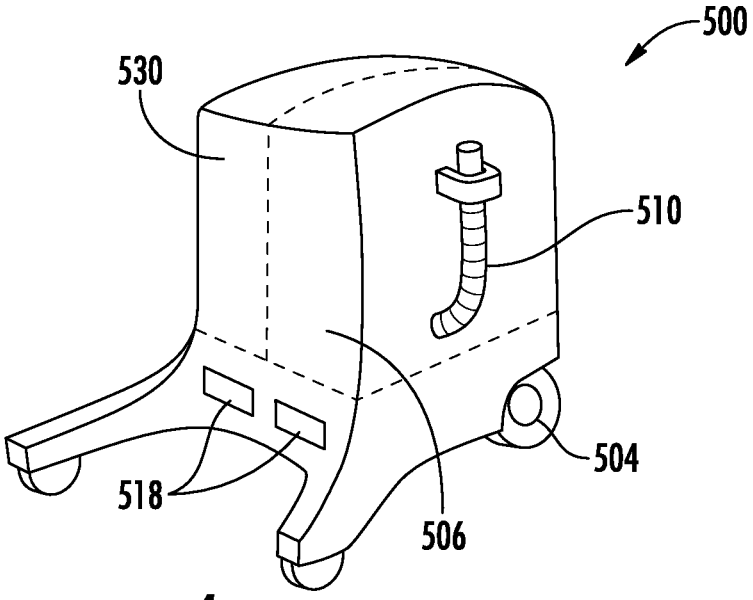
FIG. 4 is a rear perspective view of the docking station constructed in accordance with a second embodiment of the invention.
Figure 5:
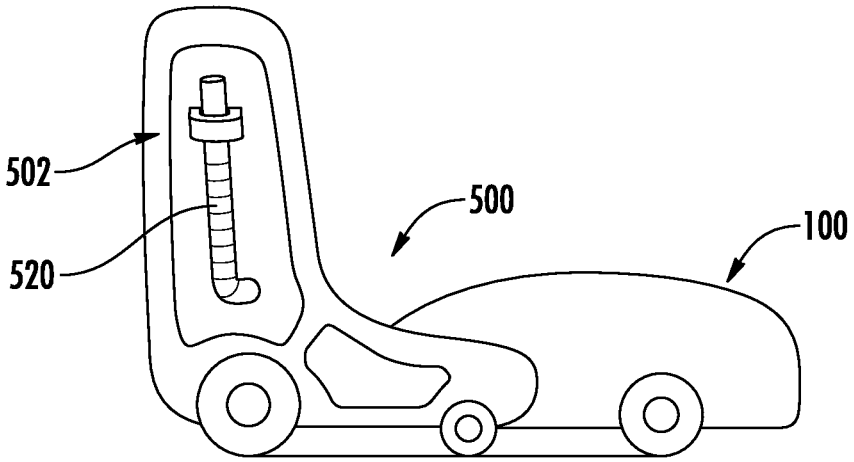
FIG. 5 is a side elevational view of the docking station constructed in accordance with the second embodiment of the invention.

In some environments which require cleaning, there is not always a ready water supply. This may be an outdoor sidewalk, a long hallway into the workout area or the like. Therefore, a portable docking station, capable of movement from a water supply and drain to the cleaning area is desired. Reference is now made to FIGS. 4 and 5 in which a portable docking station 500 constructed in accordance with yet another embodiment of the invention is provided.

Portable docking station 500 includes a body 502. Three or more wheels 504 are disposed on body 502 to facilitate movement between positions. Body 502 includes a clean water tank 530 and 8 dirty water tank 506. A first hose 520 affixed to housing 502 is in fluid communication with clean water tank 530. A second hose 510 affixed to housing 502 is in fluid communication with dirty tank 506. Housing 502 may also be provided with electrical contacts 518.

During operation, portable station 500 is moved into position for cleaning a desired area. Clean water tank 530 is filled through first hose 520 from a water supply such as a sink or outdoor faucet. Cleaning robot 100 docs with housing 502 so that contacts 518 are electrically coupled to contacts 110. In this position, cleaning robot 100 is filled with clean water by hose 520 by a pump onboard portable docking station 500, or by gravity much as described above. Similarly, dirty water tank 116 on robot 100 is drained through hose 510 into dirty water tank 506. After the cleaning operation, portable station 500 is moved to a place where clean water tank 530 may be refilled if required and dirty water tank 506 may be drained.

During operation if robot floor cleaner 100 detects that wheel slip has occurred resulting in measurement error, robot floor cleaner 100 will return to the docking station 200, 500 by following a path determined by the robot's path planning algorithm to be the shortest navigable path to the initial point 0, 0. In one embodiment, the motor for robot 100 is a brushless electric motor. As known in the art, brushless motors have an encoder that sends tick signals, the velocity of a wheel will spike in the event of slip as compared to the encoder values. In alternative embodiments the docking station 200, 500 may be provided with a beacon to indicate to robot 100 its location. Examples of beacons are Bluetooth Low Energy (BLE) beacons, optical landmark, infrared signal and the like.

It should further be recognized that the invention is not limited to the particular embodiments described above. Accordingly, numerous modifications can be made without departing from the spirit of the invention and scope of the claims appended hereto.

What is claimed is:

1. A system for autonomously cleaning a floor comprising:

a robot, the robot having a chassis, a clean water tank disposed within the chassis, and a dirty water tank disposed within the chassis, a two-way valve in fluid communication with the dirty water tank for receiving dirty water from a cleaning surface and inputting the dirty water to the dirty water tank during a cleaning operation; and a docking station having a platform for supporting the robot when the robot is in a docked position; the docking station having a drain communicating with the two-way valve for receiving contents of the dirty water tank, from the two way valve, when the robot is in the docked position; a water source communicating with the clean water tank to fill the clean water tank when the robot is in the docked position; and a charging structure to charge the robot when the robot is in the docked position.

2. The system for autonomously cleaning a floor of claim 1, wherein the docking station further comprises wheels.

3. The system for autonomously cleaning a floor of claim 1, wherein at least one of the clean water tank and dirty water tank is transparent.

4. The system for autonomously cleaning a floor of claim 1, further comprising an electrical current contact disposed on an exterior surface of the chassis; wherein the charging structure includes a charging contact, and when the electrical current contact is operatively coupled to the charging contact to charge the robot, the two-way valve is disposed in fluid communication with the drain.

5. The system for autonomously cleaning a floor of claim 1, wherein the robot further comprises a dispenser for dispensing liquid from the clean water tank.

6. The system for autonomously cleaning a floor of claim 5, wherein the robot further comprises a scrubbing pad disposed on the chassis, the scrubbing pad being down stream of the dispenser in an operating direction of the chassis.

7. The system for autonomously cleaning a floor of claim 6, wherein the two way valve is down stream of the scrubbing pad in an operating direction of the chassis.

8. The system for autonomously cleaning a floor of claim 1, wherein the two way valve is under negative pressure during a cleaning operation.

9. The system for autonomously cleaning a floor of claim 1, further comprising a drainage tank disposed within the platform and communicating with the drain.

10. The system for autonomously cleaning a floor of claim 1, wherein the dirty water tank is selectively removable from the chassis.

11. The system for autonomously cleaning a floor of claim 4, wherein the docking station further comprises a docking arm, the docking arm forming a robot receiving area with the platform, the charging contacts being disposed on the docking arm, facing the receiving area.

12. The system for autonomously cleaning a floor of claim 1, wherein the docking station further comprises a docking arm, the docking arm forming a robot receiving area with the platform, the water source being disposed in the docking arm.

13. A robot for autonomously cleaning a floor comprising:

a chassis;

a clean water tank disposed within the chassis;

a dirty water tank disposed within the chassis;

a dispenser for dispensing clean water onto the floor; and a two-way valve in fluid communication with the dirty water tank for receiving dirty water from a cleaning surface and inputting the dirty water to the dirty water tank during a cleaning operation.

14. The robot for autonomously cleaning a floor of claim 13, wherein at least one of the clean water tank and dirty water tank is transparent.

15. The robot for autonomously cleaning a floor of claim 13, further comprising a dispenser disposed on the chassis for dispensing liquid from the clean water tank.

16. The robot for autonomously cleaning a floor of claim 15, wherein the robot further comprises a scrubbing pad disposed on the chassis, the scrubbing pad being down stream of the dispenser in an operating direction of the chassis.

17. The robot for autonomously cleaning a floor of claim 16, wherein the two way valve is down stream of the scrubbing pad in an operating direction of the chassis.

18. The robot for autonomously cleaning a floor of claim 13, wherein the two way valve is under negative pressure during a cleaning operation.

19. The robot for autonomously cleaning a floor of claim 13, wherein the dirty water tank is selectively removable from the chassis.

20. A docking station for a robot for autonomously cleaning a floor comprising;

a platform for supporting a robot when the robot is in a docked position;

a drain disposed on the platform for receiving contents of a dirty water tank when the robot is in the docked position;

a water source communicating with the robot to fill the robot when the robot is in the docked position; and a charging structure to charge the robot when the robot is in the docked position.

21. The docking station for a robot for autonomously cleaning a floor of claim 20, further comprising wheels.

22. The docking station for a robot for autonomously cleaning a floor of claim 20, wherein the charging structure includes a charging contact, and when operatively coupled to the robot to charge the robot, a valve on the robot to discharge dirty water is disposed in fluid communication with the drain.

23. The docking station for a robot for autonomously cleaning a floor of claim 20, further comprising a drainage tank disposed within the platform and communicating with the drain.

24. The docking station for a robot for autonomously cleaning a floor of claim 20, further comprising a docking arm, the docking arm forming a robot receiving area with the platform, the charging structure being disposed on the docking arm, facing the receiving area.

25. The docking station for a robot for autonomously cleaning a floor of claim 20, further comprising a docking arm, the docking arm forming a robot receiving area with the platform, the water source being disposed in the docking arm.

* * * * *